United States Patent [19]

Ito et al.

[11] 4,249,790

[45] Feb. 10, 1981

[54] COAXIAL CABLE CONNECTOR PLUG

[75] Inventors: Katsuo Ito; Bunjiro Murata, both of Kanazawa; Kazunori Yoshimura, Ishikawa, all of Japan

[73] Assignee: Murata Manufacturing Co., Ltd., Japan

[21] Appl. No.: 66,561

[22] Filed: Aug. 15, 1979

[30] Foreign Application Priority Data

Aug. 22, 1978 [JP] Japan ..... 53-115571

[51] Int. Cl.[3] ..... H01R 17/04

[52] U.S. Cl. ..... 339/177 E

[58] Field of Search ..... 339/177 R, 177 E

[56] References Cited

U.S. PATENT DOCUMENTS

| | | | |
|---|---|---|---|
| 3,278,805 | 10/1966 | Matto | 339/177 R |
| 3,437,982 | 4/1969 | O'Keefe et al. | 339/177 R |
| 4,070,751 | 1/1978 | Hogendobler et al. | 113/119 |

FOREIGN PATENT DOCUMENTS

| | | | |
|---|---|---|---|
| 1490421 | 11/1977 | United Kingdom | 339/177 R |

*Primary Examiner*—Neil Abrams

*Attorney, Agent, or Firm*—Ostrolenk, Faber, Gerb & Soffen

[57] ABSTRACT

A coaxial cable is electrically connected to a connector receptacle by means of a coaxial cable connector plug. The coaxial cable connector plug comprises a clip which acts as an elastic pressure contact connected to a central conductor of the coaxial cable, and a plug pin electrically connected to the clip and adapted to be inserted into a receptacle opening of the connector receptacle. The clip and the plug pin are integrally formed in a single metallic plate. The clip is formed by folding the metallic plate at one end portion, while the plug pin is formed at the other end portion of the metallic plate by curling the same, with engaging portions being formed at the joint portion of the clip and the plug pin and protruding in the direction orthogonal to the longitudinal direction. The clip is housed in an insulating inner casing, while the pin is guided outward extending therefrom. The inner casing is covered with a shield casing. The inner casing is formed with an aperture for insertion of a center conductor of a coaxial cable at the position corresponding to the clip and the shield casing is formed with an aperture for insertion of an inner insulation of the coaxial cable at the corresponding portion. An outer conductor of the coaxial cable is pressure fixed to the side surface of the shield casing.

11 Claims, 14 Drawing Figures

COAXIAL CABLE CONNECTOR PLUG

BACKGROUND OF THE INVENTION

1. Field of the Invention

The present invention relates to a coaxial cable connector plug. More specifically, the present invention relates to a coaxial cable connector plug for connection of a coaxial cable to a connector receptacle.

2. Description of the Prior Art

FIG. 1 shows a side view of a conventional coaxial cable connector plug and FIG. 2 is a sectional view of the FIG. 1 connector plug showing the internal structure thereof. The coaxial cable connector plug shown is often referred to as a push-on type. For example, as shown in FIG. 2 in a supplemental manner, the connector plug shown can be connected to a connector receptacle 1 by simply inserting the connector plug shown into the connector receptacle 1.

The push-on type connector plug comprises an inner casing 11 made of an insulating material such as insulating resin which comprises two portions, i.e. a first portion 13 and a second portion 12. The second portion 12 is fabricated by inserting a plug pin 14 of a conductive material in molding the second portion 12 such that the plug pin 14 protrudes outward. A clip 15 made of a conductive material is fixed to the root portion of the plug pin 14, such that the clip 15 extends in the direction opposite to that of the plug pin 14 and is positioned within the first portion 13. The first portion 13 is formed with a passage or an aperture 18 for receiving a center conductor 17 of a coaxial cable 16.

A shield casing 19 made of a conductive material is disposed to enclose the above described inner casing 11. An end portion of the inner casing 11 for receiving the outer conductor of the coaxial cable 16 is tapered and accordingly the shield casing 19 is also tapered at the corresponding portion. The shield casing 19 is opened at both ends in the axial direction. One end opening of the shield casing 19 faces the aperture 18 of the first portion 13 of the above described inner casing 11 and receives the inner insulation of the coaxial cable 16. The other end opening of the shield casing 19 surrounds the periphery of the plug pin 14 and a portion 19*a* of the shield casing 19 is adapted to be elastically inserted into a connecting portion 1*b* of the connector receptacle 1. The shield casing 19 is shaped such that it is favorably fixed when inserted into a cover ring 20, made of an insulating material, together with the inner casing 11.

An outer conductor 21 of the coaxial cable 16 is disposed to cover the tapered portion of the shield casing 19 and is sandwiched between a cap 22 made of an insulating material screwed on the cover ring 20 and the inner casing 11, whereby the outer conductor 21 is electrically connected to the shield casing 19 while the coaxial cable 16 is mechanically connected to the connector plug. In such a situation the center conductor 17 is sandwiched by fingers of the clip 15 and thus electrically connected to the clip 15.

Thus the push-on type connector plug is electrically and mechanically connected to the coaxial cable 16 and, by inserting the same into the connector receptacle 1, an electrical connection of the connector plug and thus the coaxial cable to the connector receptacle 1 is achieved. More specifically, the plug pin 14 of the connector plug is inserted into the receptacle aperture 1*a* of the connector receptacle 1 to achieve an electrical connection, while a metallic portion 1*b* of the connector receptacle 1 is inserted into a portion 19*a* of the shield casing 19 to achieve an electrical connection. Accordingly, the receptacle aperture 1*a* of the connector receptacle 1 is connected to the center conductor 17 of the coaxial cable 16 and the metallic portion 1*b* of the connector receptacle 1 is connected to the outer conductor 21 of the coaxial cable 16.

However, according to the above described structure of the connector plug, the plug pin 14 being inserted into the second portion 12 of the inner casing 11 is fabricated by cutting work. For this reason the cost of the connector plug is relatively high. Furthermore the clip 15 is fixed to the plug pin 14 by caulking and a caulking step is required in fabrication and the number of components is increased. In addition, the step of fixing the clip 15 to the plug pin 14 by caulking requires a delicate processing work, which is relatively tiresome and nevertheless could be of less reliability.

SUMMARY OF THE INVENTION

Briefly described, the present invention comprises a connection member formed in a single metallic plate and including a contact portion and a pin portion, which are made of a single metallic plate. The connection member is formed with an engaging portion located at the junction between the contact portion and the pin portion, the engaging portion protruding in the direction orthogonal to the longitudinal direction thereof. An inner casing made of an insulating material comprises a first portion and a second portion and the contact portion of the connection member is housed within the inner casing such that the pin portion is protruded outward. At least one of the first portion and the second portion of the inner casing is formed of a groove for receiving the engaging portion of the connection member, thereby to position and fix the connection member to the inner casing. The inner casing is covered with a shield casing having openings at both ends and a center conductor of the coaxial cable is connected to the contact portion of the connection member through the shield casing and a passage formed in the first portion of the inner casing. An outer conductor of the coaxial cable is fixed in a pressed manner to the side surface of the shield casing by means of a fixing means.

Accordingly, a principal object of the present invention is to provide an improved coaxial cable connector plug.

Another object of the present invention is to provide an inexpensive coaxial cable connector plug.

A further object of the present invention is to provide a coaxial cable connector plug of a simple structure and of a reduced number of components.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
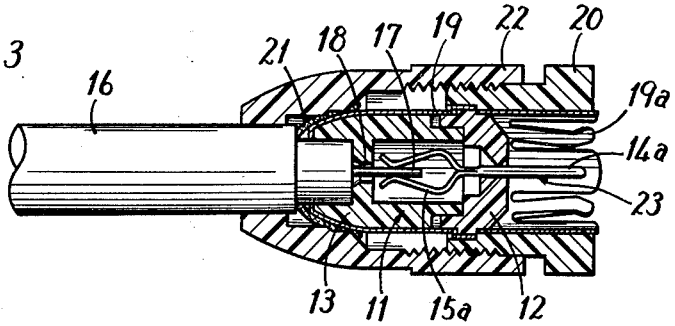
FIG. 3 is similar to FIG. 2 but shows a sectional front view of an embodiment of the present invention.
Figure 4:
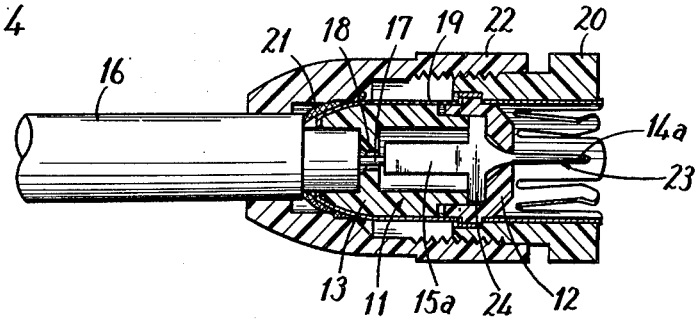
FIG. 4 is a sectional top view of the FIG. 3 embodiment.

FIGS. 3 to 11 show one embodiment of the present invention. Specifically, FIG. 3 is a sectional front view showing the whole structure of the embodiment and FIG. 4 is a sectional plan view of the inventive connector plug.

Figure 1:
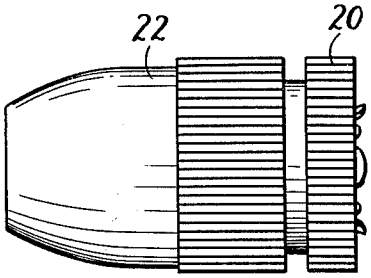
FIG. 1 PRIOR ART
FIG. 1 is a side view of a conventional coaxial cable connector plug.
Figure 2:
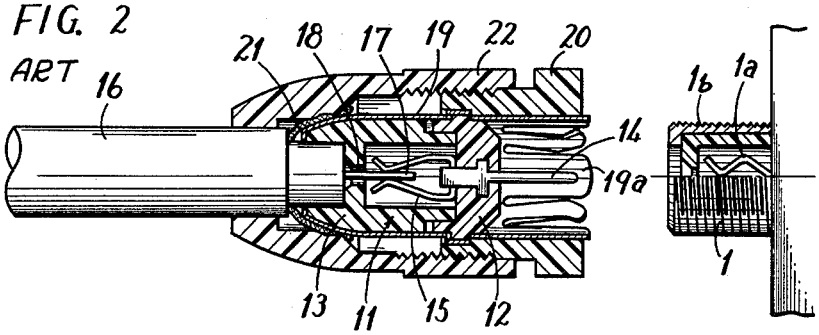
FIG. 2 PRIOR ART
FIG. 2 is a sectional front view of the FIG. 1 connector plug for showing the internal structure thereof.

Referring to FIGS. 3 and 4, the embodiment shown is different from the prior art connector plug shown in FIG. 2 in the following respects. The embodiment shown comprises a unitary center conductor connection member 23 which integrally comprises a plug pin portion 14*a* and a clip portion 15*a*. Furthermore, the internal structure of the second portion 12 of the inner casing 11 for substantially retaining the connection member 23 has been changed. Such structural features of the embodiment will be described in more detail below.

Figure 5:
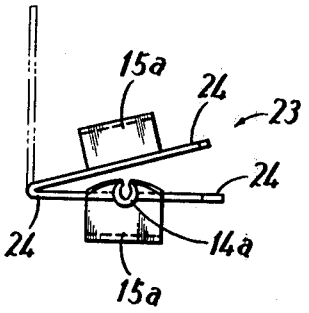
FIG. 5 is a side view of a connection member employed in the embodiment shown in FIGS. 3 and 4.
Figure 6:
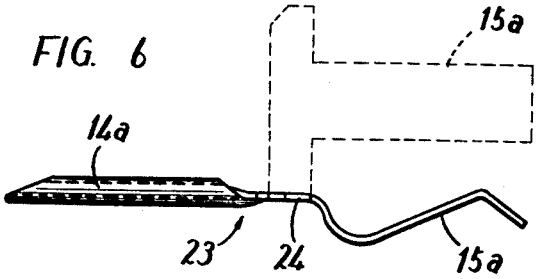
FIG. 6 is a front view of the FIG. 5 connection member.
Figure 7:
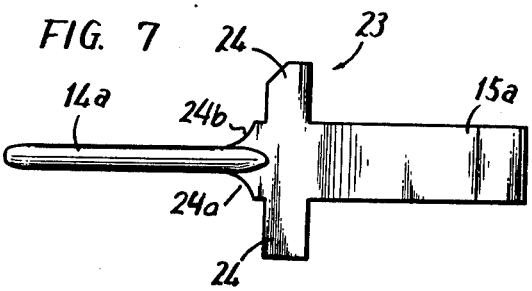
FIG. 7 is a plan view of the FIG. 5 connection member.

FIGS. 5, 6 and 7 are side, front and plan views, respectively, of the connection member 23. The connection member 23 is formed from a single metallic plate. The plug pin portion 14*a* is formed by curling one end portion of the material (FIG. 5). The clip portion 15*a* is formed by folding the other end portion such that the metal plate portions are faced to each other. Engaging portions 24 are formed to protrude extending outward at the junction portion between the plug pin portion 14*a* and the clip portion 15*a*. Thus, the connection member 23 integrally defines the plug pin portion 14*a*, the clip portion 15*a* and the engaging portions 24. A pair of side edges 24*a*, 24*b* slanting toward said pin portion 14*a* are located intermediate engaging portions 24 and pin portion 14*a*.

Figure 8:
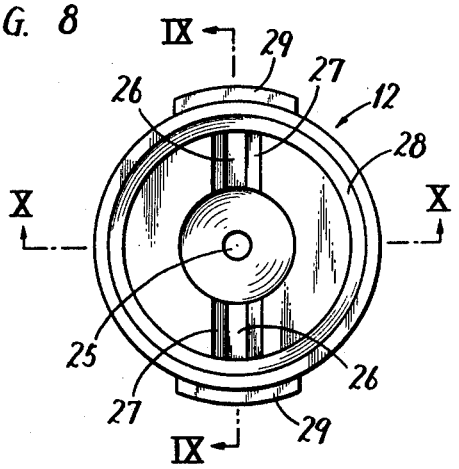
FIG. 8 is a side view of the second portion of the inner casing.
Figure 9:
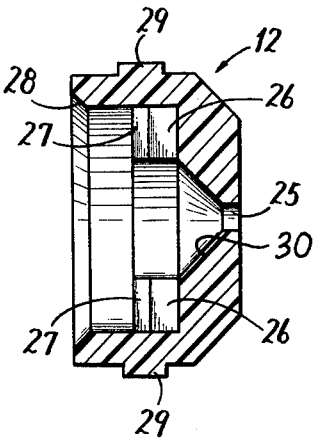
FIG. 9 is a sectional view taken along the line IX—IX shown in FIG. 8.
Figure 10:
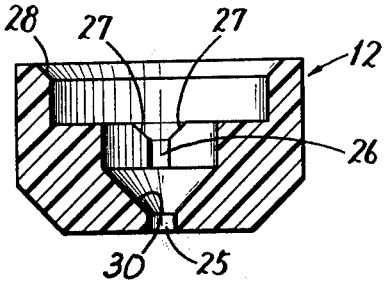
FIG. 10 is a sectional view taken along the line X—X shown in FIG. 8.

FIGS. 8, 9 and 10 show a side view, a sectional view taken along the line IX—IX shown in FIG. 8 and a sectional view taken along the line X—X shown in FIG. 8, respectively, of the second portion 12 shown in FIGS. 3 and 4. The second portion 12 shown functions to substantially retain the above described connection member 23 in place. To that end, the second portion 12 comprises an aperture 25 for insertion of the plug pin portion 14*a* of the connection member 23 and grooves 26 for receiving the engaging portion 24 of the connection member 23. The engaging portion 24 of the connection member 23 is inserted into the grooves 26 and is received thereby. A slanted opening 30 is formed in second portion 12 to receive side edges 24*a*, 24*b* when pin portion 14*a* is inserted through aperture 25. In order to facilitate such insertion, the grooves 26 are formed of tapered portions 27 at the upper end of the side wall thereof. The second portion 12 is fitted into the first portion 13 (FIGS. 3 and 4) thereby to form the single inner casing 11. In order to readily guide the above described first portion 13, the opening end edge thereof is formed of a tapered portion 28. The second portion 12 is provided with a protruding portion 29 at an outer peripheral surface of the second portion 12, such that the same favorably functions to position the shield casing 19 (FIGS. 3 and 4).

Meanwhile, it is pointed out that the groove 26 for the engaging portion 24 may be provided at the first portion 14 rather than at the second portion 12, or may be provided both at the first and second portions 14 and 12 for cooperatively receiving the engaging portion 24.

Figure 11:
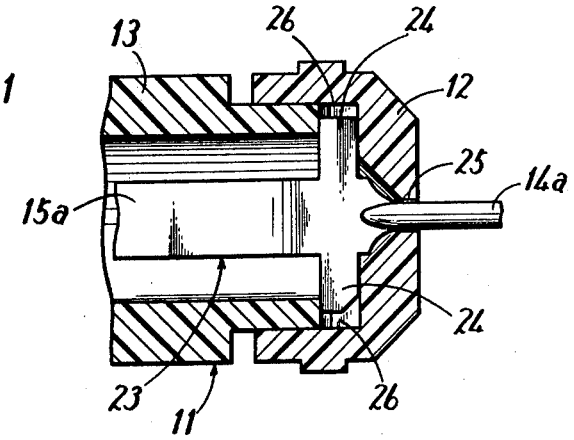
FIG. 11 is a sectional view of a major portion of the connection member as positioned and retained in the inner casing.

FIG. 11 is a sectional view of a major portion of the connection member 23 being positioned and retained within the inner casing 11. Referring to FIG. 11, the engaging portion 24 of the connection member 23 inserted and received by the grooves 26 of the second portion 12 is pressed by the end surface of the first portion 13, whereby the same is substantially fixed in place. In such a state, the plug pin portion 14*a* of the connection member 23 is inserted into the aperture 25 to be protruded from the inner casing 11, while the clip portion 15*a* is positioned at the side opposite to the protruding direction of the plug pin portion 14*a*. Thus, the embodiment shown of the inventive connector plug is provided. Since the remaining portions of the structure shown of the embodiment are substantially the same as those shown in the conventional connector plug shown in FIGS. 2 and 3, a description of the same is omitted.

According to the embodiment shown, the connection member 23 is favorably fixed by simply fixing the second portion 12 to the first portion 13.

Figure 12:
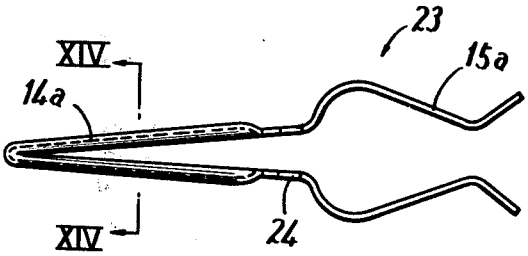
FIG. 12 is a front view of another embodiment of the connection member.
Figure 13:
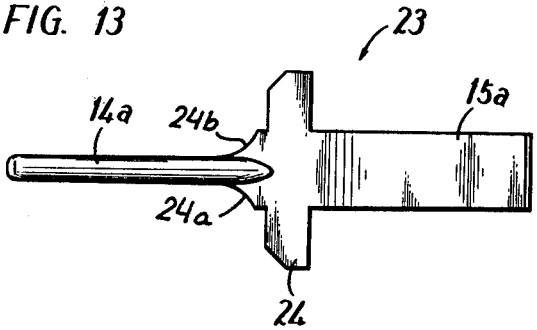
FIG. 13 is a plan view of the FIG. 12 connector member.
Figure 14:
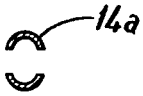
FIG. 14 is an end view of the connection member taken along the line XIV—XIV shown in FIG. 12.

FIGS. 12, 13 and 14 show a front view, a plan view and a sectional end view taken along the line XIV—XIV shown in FIG. 12, respectively, of a second embodiment of the above described connection member 23. The connection member 23 shown in these figures is also provided by forming a single metallic plate. A plug pin 14*a* is formed at one end of the connection member 23 and a clip portion 15*a* is formed at the other end, while the engaging portions 24 are formed to protrude from the intermediate portion. The metallic plate is folded at the tip end of the plug pin portion 14*a*, whereby the plug pin portion 14*a*, the engaging portion 24 and the clip portion 15*a* are formed as a 2-layered metallic plate. As better shown in FIG. 14, the layered metallic plates at the plug pin portion 14*a* are each curled in a semicircular shape, whereby the plug pin portion 14*a* is formed in a cylindrical shape. The connection member 23 thus obtained may be similarly positioned and retained in the above described inner casing 11.

As described in the foregoing, according to the present invention, a clip portion and a plug pin portion of a connector plug can be integrally fabricated from a single metallic plate and this can reduce a cost thereof. At the same time, the number of components can also be reduced, which facilitates assemblage of the inventive connector plug and thus reduces the cost thereof. Furthermore, the step of fixing a plug pin to a clip can be dispensed with, which enhance a reliability of an electrical connection of the inventive connector plug.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coaxial cable connector plug for electrically connecting a coaxial cable including a center conductor, an inner insulation covering said center conductor, and an outer conductor, to a connector receptacle having a receptacle opening, said connector plug comprising:

a connection member including a contact portion being electrically connected to said center conductor of said coaxial cable, and a pin portion being electrically connected to said contact portion and being adapted to be electrically connected to said connector receptacle;

said contact portion and said pin portion of said connection member being integrally made of a single metallic plate, said contact portion being formed at one longitudinal end of said metallic plate and said pin portion being formed at the other longitudinal end of said metallic plate, an engaging portion being further formed in said connection member at a position intermediate said contact portion and said pin portion and protruding in a direction orthogonal to the longitudinal direction of said connection member;

said engaging portion comprising two layered engaging pieces facing each other and formed by folding said single metallic plate;

an inner casing made of an insulating material and receiving said contact portion of said connection member, said inner casing comprising first and second portions, said first portion including a first aperture for guiding said center conductor of said coaxial cable into the inside of said inner casing, at least one of said first portion and said second portion having a groove formed therein, said groove receiving said engaging portion of said connection member, and a second aperture formed in said second portion, said pin portion extending through said second aperture and outside said inner casing;

a shield casing made of a conductive material for covering said inner casing, said shield casing having openings formed at both ends thereof, one opening of said shield casing being adapted to receive said inner insulation of said coaxial cable; and connecting/fixing means for electrically connecting and fixing said outer conductor of said coaxial cable to said shield casing.

2. A coaxial cable connector plug in accordance with claim 1, wherein said contact portion of said connection member comprises two contact pieces facing each other, said contact pieces being defined by folds in said single metallic plate which cause said contact pieces to be in elastic pressure contact with said center conductor of said coaxial cable.

3. A coaxial cable connector plug in accordance with claim 2, wherein said two contact pieces are folded towards each other along portion of the longitudinal length, said folds causing said contact pieces to be elastically biased towards each other and facilitating insertion of said center conductor of said coaxial cable between said contact pieces.

4. A coaxial cable connector plug in accordance with claim 2, wherein said pin portion of said connection member comprises two semicylindrical portions faced to each other to define a cyrindrical portion which is formed by folding said single metallic plate.

5. A coaxial cable connector plug for electrically connecting a coaxial cable including a center conductor, an inner insulation covering said center conductor, and an outer conductor, to a connector receptacle having a receptacle opening, said connector plug comprising:

a connection member including a contact portion being electrically connected to said center conductor of said coaxial cable, and a pin portion being electrically connected to said contact portion and being adapted to be electrically connected to said connector receptacle;

said contact portion and said pin portion of said connection member being integrally made of a single metallic plate, said contact portion being formed at one longitudinal end of said metallic plate and said pin portion being formed at the other longitudinal end of said metallic plate, an engaging portion being further formed in said connection member at a position intermediate said contact portion and said pin portion and protruding in a direction orthogonal to the longitudinal direction of said connection member;

said engaging portion comprising two layered engaging pieces facing each other and formed by folding said single metallic plate;

said contact portion of said connection member comprising two contact pieces facing each other, said contact pieces being defined by folds in said single metallic plate which cause said contact pieces to be in elastic pressure contact with said central conductor of said coaxial cable;

an inner casing made of an insulating material and receiving said contact portion of said connection member, said inner casing comprising first and second portions, said first portion including a first aperture for guiding said center conductor of said coaxial cable into the inside of said inner casing, at least one of said first portion and said second portion having a groove formed therein, said groove receiving said engaging portion of said connection member, and a second aperture formed in said second portion, said pin portion extending through said second aperture and outside said inner casing;

a shield casing made of a conductive material for covering said inner casing, said shield casing having openings formed at both ends thereof, one opening of said shield casing being adapted to receive said inner insulation of said coaxial cable; and connecting/fixing means for electrically connecting and fixing said outer conductor of said coaxial cable to said shield casing.

6. A coaxial cable connector plug in accordance with claim 1 or 5, wherein said pin portion of said connection member is formed by curling an elongated portion of said metallic plate into a cylindrical shape, and wherein said axis of said cylindrical shape is coaxial with the axis of said connection member.

7. A coaxial cable connector plug in accordance with claim 6, wherein said pin portion is tapered at the distal end thereof.

8. A coaxial cable connector plug in accordance with claim 1 or 5, wherein a side edge slanted towards said pin portion is formed in said single metallic plate at a junction portion intermediate said engaging portion and said pin portion of said connection member and wherein said groove is formed in said second portion of said inner case and includes a slanted portion receiving said slanted side edge of said connection member.

9. A coaxial cable connector plug in accordance with claims 1 or 5, wherein said groove is formed in said second portion and end portion of said first portion of said inner casing is positioned at an inner portion of an end portion of said second portion; said end portion of said first portion pressing said engaging portion of said connection member toward said groove of said second portion when said engaging portion of said connection portion is fitted in said groove of said second portion.

10. A coaxial cable connector plug in accordance with claims 1 or 5, wherein said groove is formed in said second portion and further including tapered portions formed in said second portion for guiding said engaging portion into said groove as said pin portion is inserted into said second aperture.

11. A coaxial cable connector plug in accordance with claims 1 or 5, wherein said pin portion of said connection member comprises two semicylindrical portions facing each other to define a cylindrical portion which is formed by folding said single metallic plate.

* * * * *